US011447720B2

(12) United States Patent
Best et al.

(10) Patent No.: US 11,447,720 B2
(45) Date of Patent: Sep. 20, 2022

(54) LIQUID DETERGENT COMPOSITION

(71) Applicant: Conopeo, Inc., Englewood Cliffs, NJ (US)

(72) Inventors: Jonathan Best, Merseyside (GB); Panchanan Bhunia, Bangalore (IN); Robert John Carswell, Merseyside (GB); Richa Sureshchand Goyal, Mumbai (IN); Sujitkumar Suresh Hibare, Bangalore (IN); Alagirisamy Nethaji, Mumbai (IN); Abhishek Rastogi, Bijnor (IN); Savitha Sudhir, Bangalore (IN)

(73) Assignee: Conopeo, Inc., Englewood Cliffs, NJ (US)

( * ) Notice: Subject to any disclaimer, the term of this patent is extended or adjusted under 35 U.S.C. 154(b) by 39 days.

(21) Appl. No.: 16/617,453

(22) PCT Filed: May 30, 2018

(86) PCT No.: PCT/EP2018/064250
§ 371 (c)(1),
(2) Date: Nov. 26, 2019

(87) PCT Pub. No.: WO2018/220049
PCT Pub. Date: Dec. 6, 2018

(65) Prior Publication Data

US 2020/0165542 A1 May 28, 2020

(30) Foreign Application Priority Data

May 30, 2017 (EP) ..... 17173355
May 30, 2017 (EP) ..... 17173356

(51) Int. Cl.

| | |
|---|---|
| ***C11D 1/22*** | (2006.01) |
| ***C11D 1/29*** | (2006.01) |
| ***C11D 1/83*** | (2006.01) |
| ***C11D 3/04*** | (2006.01) |
| ***C11D 3/37*** | (2006.01) |
| ***C11D 17/00*** | (2006.01) |
| ***C11D 1/14*** | (2006.01) |
| ***C11D 1/28*** | (2006.01) |
| ***C11D 11/00*** | (2006.01) |

(52) U.S. Cl.
CPC ..... *C11D 1/143* (2013.01); *C11D 1/146* (2013.01); *C11D 1/28* (2013.01); *C11D 1/29* (2013.01); *C11D 1/83* (2013.01); *C11D 3/046* (2013.01); *C11D 3/37* (2013.01); *C11D 11/0017* (2013.01); *C11D 17/0008* (2013.01)

(58) Field of Classification Search
None
See application file for complete search history.

(56) References Cited

U.S. PATENT DOCUMENTS

| | | | | |
|---|---|---|---|---|
| 2,598,629 | A | 5/1952 | Whyte | |
| 2,748,988 | A | 6/1956 | Fromson | |
| 3,214,783 | A | 2/1965 | Perry et al. | |
| 3,231,145 | A | 1/1966 | Converse | |
| 3,880,532 | A | 4/1975 | O'Hare | |
| 4,411,376 | A | 10/1983 | Bennett et al. | |
| 4,482,470 | A | 11/1984 | Reuter et al. | |
| 5,006,273 | A * | 4/1991 | Machin | C11D 17/0026 510/418 |
| 5,108,644 | A | 4/1992 | Machin et al. | |
| 5,230,446 | A | 7/1993 | Valda | |
| 5,397,493 | A * | 3/1995 | Potocki | C11D 3/30 252/301.21 |
| 5,968,202 | A | 10/1999 | Verbiest et al. | |
| 6,004,920 | A | 12/1999 | Pollack et al. | |
| 6,048,368 | A * | 4/2000 | Tcheou | A47L 25/08 510/276 |
| 6,152,152 | A * | 11/2000 | Reynen | C11D 1/86 134/25.2 |
| 6,746,166 | B1 | 8/2004 | Jeon et al. | |
| 7,721,372 | B2 | 5/2010 | Knopow et al. | |

(Continued)

FOREIGN PATENT DOCUMENTS

| | | |
|---|---|---|
| CN | 2324850 | 6/1999 |
| CN | 1288496 | 3/2001 |

(Continued)

OTHER PUBLICATIONS

Search Report and Written Opinion in EP17173356; dated Dec. 12, 2017.
Search Report and Written Opinion in PCTEP2018064250; dated Jul. 6, 2018.
Search Report and Written Opinion in EP17173355; dated Dec. 8, 2017.
Search Report & Written Opinion in EP15190576; dated Apr. 5, 2016.

(Continued)

*Primary Examiner* — Lorna M Douyon
(74) *Attorney, Agent, or Firm* — Greenberg Traurig, LLP

(57) ABSTRACT

The present invention provides a liquid detergent composition comprising anionic surfactants, optionally one or more nonionic surfactants, polyethylene glycol, and water, and wherein the liquid detergent composition has a pH of 7.0 to 7.5, wherein the liquid detergent composition has a viscosity at 25° C. and 20 $s^{-1}$ in the range of 5 to 100 mPa $s^{-1}$, and wherein the liquid laundry composition has stable viscosity between a temperature range of 10 and 40° C., and wherein the composition is adapted for application with a hand-held dispensing device used for washing by hand. The liquid detergent composition has a low constant viscosity throughout the temperature range of normal use and produces a stable foamy lather.

11 Claims, No Drawings

(56) References Cited

U.S. PATENT DOCUMENTS

| | | | | |
|---|---|---|---|---|
| 2002/0028755 | A1* | 3/2002 | Van Dijk | C11D 3/38663 510/392 |
| 2002/0198130 | A1 | 12/2002 | Arvanitidou et al. | |
| 2005/0130859 | A1* | 6/2005 | Gupta | C11D 3/50 510/267 |
| 2010/0075878 | A1* | 3/2010 | Gizaw | C11D 3/382 510/119 |
| 2011/0052306 | A1 | 3/2011 | Cavaiani | |
| 2014/0157527 | A1 | 6/2014 | Corradini et al. | |

FOREIGN PATENT DOCUMENTS

| | | |
|---|---|---|
| CN | 202980758 | 6/2013 |
| CN | 203435875 | 2/2014 |
| CN | 1639408 | 7/2015 |
| EP | 0301883 | 2/1989 |
| EP | 0781836 | 7/1997 |
| EP | 0781838 | 7/1997 |
| EP | 2308957 | 4/2011 |
| EP | 2489722 | 8/2012 |
| JP | 58187498 | 11/1983 |
| JP | 61288000 | 12/1986 |
| JP | 8283784 | 10/1996 |
| JP | 10130693 | 5/1998 |
| JP | 2004217908 | 4/2005 |
| JP | 2006016425 | 1/2006 |
| JP | 5164832 | 3/2013 |
| KR | 20000049380 | 8/2000 |
| WO | WO9516767 | 6/1995 |
| WO | WO9738672 | 10/1997 |
| WO | WO9920727 | 4/1999 |
| WO | WO9933942 | 7/1999 |
| WO | WO9937849 | 7/1999 |
| WO | WO0028873 | 5/2000 |
| WO | WO0107705 | 2/2001 |
| WO | WO0146374 | 6/2001 |
| WO | WO0216686 | 2/2002 |
| WO | WO03074775 | 9/2003 |
| WO | WO2012175989 | 12/2012 |
| WO | WO2013092049 | 6/2013 |

OTHER PUBLICATIONS

Search Report and Written Opinion in PCTEP2016074700; dated Jan. 26, 2017.
Written Opinion 2 in PCTEP2016074700; dated Sep. 5, 2017.
IPRP2 in PCTEP2016074700; dated Jan. 29, 2018.
Database WPI, Week 199830, Thomson Scientific, London, GB XP2775988; 1998.

* cited by examiner

LIQUID DETERGENT COMPOSITION

RELATED APPLICATIONS

This application is a national phase filing under 35 USC 371 of International Application No. PCT/EP2018/064250, filed on May 30, 2018, which claims priority from European Patent Application Nos. 17173355.3 and 17173356.1 filed, May 30, 2017, the contents of which are incorporated herein in their entirety for all purposes.

FIELD OF THE INVENTION

The present invention relates to a high foaming liquid detergent composition that exhibits low viscosity variation as a function of temperature. The invention further relates to a method of cleaning textile using the aforementioned liquid detergent composition and a kit for applying the liquid detergent composition.

BACKGROUND OF THE INVENTION

Liquid detergents are becoming increasingly popular as compared to traditional detergent bars or powders, especially owing to the convenience they offer. Liquid detergents dissolve quickly in water, spread uniformly over the textile and are completely rinsed off during the washing cycle, reducing the chance of skin irritation due to solid detergent residues accumulated in the textile fibres.

Consumers prefer high foaming liquid detergents because high foam is seen as a key cue of cleaning efficacy.

A problem associated with high foaming liquid detergents is that their viscosity tends to drastically change as a function of temperature. A conventional high foam laundry liquid detergent may vary in viscosity from 10,000 cP at 10° C. to 50 cP at 40° C. This can lead to issues such as poor control of product dosage, especially if the liquid detergent is directly applied onto fabric during hand washing with the help of a dispensing device.

JP 2014037503 describes liquid laundry detergents comprising:

(a) 0.01-5 mass % solvent represented by formula (I):

$$R^1—O—(R^2O)_n—H \quad (I)$$

wherein:

$R^1$ represents a hydrogen atom or a $C_{1-8}$ alkyl;

$R^2$ represents a $C_{3-5}$ alkylene group having a carbon number from 3 to 5;

n is a number from 10 to 350 that represents the average number of $R^2O$;

(b) alkylbenzene sulphonate;

(c) polyoxyalkylene alkyl ether sulphate;

(d) 0-20 mass % of non-ionic surfactant;

(e) water.

WO 97/38672 describes an aqueous liquid detergent composition comprising a synthetic anionic surfactant and an amphoteric surfactant in a weight ratio within the range 4:1 to 0.1:1 and a polyethylene glycol having a molecular weight of not more than 100,000.

WO 99/33942 describes a detergent composition comprising a mixture of:

a) at least about 5 wt % of a surfactant comprising one or more anionic surfactants; said detergent composition being free of a quaternary nitrogen containing cationic compound;

b) from 0 up to about 40 wt % of at least one detergent builder;

c) from 0 up to about 5 wt % of at least one enzyme; and d) at least about 0.1 wt % of a water soluble organic polymer which is miscible with or soluble in said surfactant.

U.S. Pat. No. 5,108,644 describes an aqueous surfactant structured liquid detergent concentrate comprising from 0-10% by volume suspended solid material and further comprising:

(a) at least 15% by weight of detergent active material, said material comprising: (A) anonionic surfactant or a polyalkoxylated anionic surfactant or mixture thereof; and (B) a non-polyalkoxylated anionic surfactant; wherein the weight ratio of component (A) to component (B) is from 2.8:1 to 1:4;

(b) from 1 to 30% of a salting out electrolyte;

(c) from 0.1 to 20% by weight of a viscosity reducing water soluble polymer, which polymer is a polyethylene glycol polymer.

WO 2012/156250 describes an aqueous concentrated liquid laundry detergent comprising:

at least 8 wt % anionic non-soap surfactant;

at most 30 wt % of nonionic surfactant;

at most 10 wt % of surfactant other than (a) and (b)

at least 0.1 wt % alkyl hydroxamate; and at least 2 wt % nonionic ethoxylated polyethylene imine with an average of between 7 and 40 ethoxy units per substitution site on each nitrogen.

WO 01/46374 describes a laundry and/or cleaning and/or fabric care composition comprising a detergent and/or cleaning and/or surfactant and/or fabric care ingredient and a benefit agent, said benefit agent being carried with a carrier, characterised in that the carried benefit agent has a viscosity of at least 400 cps at 20° C.

EP-A 0 781 838 describes detergent composition comprising a mixture of:

a) at least about 5 wt % of a surfactant mixture comprising (i) an anionic surfactant and/or a nonionic surfactant; and (ii) an amphoteric surfactant.

b) at least about 0.1 wt % of a water soluble organic polymer which is miscible with or soluble in said surfactant;

c) from 0 up to about 5 wt % of at least one enzyme; said composition providing a cleaning performance in the wash bath which is superior to the cleaning provided by an otherwise identical detergent composition which is free of said water soluble organic polymer.

EP-A 0 301 883 describes aqueous surfactant-structured liquid detergent concentrates comprising less than 15% by volume suspended solid material and further comprising: discloses liquid detergents with high concentrations of surfactant and no more than 5% by weight of swelling clay, comprising less than 15% by volume of suspended solid material and further comprising:

(a) at least 15% by weight of detergent active material;

(b) from 1 to 30% by weight of a salting-out electrolyte;

(c) from 0.1 to 20% by weight of a viscosity reducing water soluble polymer in an amount sufficient to reduce the viscosity by more than 5% when measured at a shear rate of 21 $s^{-1}$ and in comparison with a composition identical except that all such polymer is omitted; said viscosity reducing polymer having molecular weight of at least 1000.

SUMMARY OF THE INVENTION

The inventors have developed a high foaming liquid detergent composition whose viscosity does not change substantially within the temperature range in which the composition is normally used (10° C. to 40° C.). This liquid detergent composition is particularly suited for application in hand-held devices that are used gradually to dispense liquid detergent onto fabric during washing by hand as it provides predictable flow characteristics across a range of temperatures.

Accordingly, the present invention provides a high foaming liquid detergent composition comprising:

- 5 to 17.5 wt. % of one or more anionic surfactants selected from non-alkoxylated non-soap anionic surfactant and an alkoxylated anionic surfactant in a weight ratio of 2:1 to 5:1, said non-alkoxylated non-soap anionic surfactant being selected from linear alkylbenzene sulphonate, alpha-olefin sulphonate, methyl ester sulphonate, primary alcohol sulphate and combinations thereof;
- 0 to 0.5 wt. % of one or more nonionic surfactants;
- 2.0 to 4 wt. % of polyethylene glycol having a molecular weight of 4,000 Da to 6,000 Da;
- at least 50 wt. % water;

wherein the liquid detergent composition has a viscosity at 25° C. and 20 $s^{-1}$ in the range of 5 to 100 mPa $S^{-1}$, wherein the liquid detergent composition forms a foam volume of at least 100 ml, wherein the liquid detergent composition has a pH of 7.0 to 7.5, and wherein the liquid laundry composition has stable viscosity between a temperature range of 10 and 40° C.

Most of liquid detergent compositions have high exponential decay function for viscosity with temperature. The present invention discloses liquid detergent compositions that have a low viscosity decay function across a range of temperatures. This is particularly advantageous for maintaining predictable flow characteristics of the composition across a range of temperatures at which the composition is typically used by a consumer for hand-wash application of the composition utilizing a hand-held dispensing device.

In context of the present invention, a viscosity-temperature sensitivity factor $K_\eta$ of less than 12.04 across a temperature range of 10 to 40° C. is desired. A $K_\eta$ of less than 12.04 indicates that the viscosity of the liquid detergent composition does not change much as a function of temperature. The viscosity-temperature sensitivity factor being calculated according to the following equation:

$$K_\eta=(\eta_{10})/\eta_{40};$$

wherein $\eta_T$ is the viscosity in cP at a shear rate of 20 $s^{-1}$ and a temperature T in ° C.

The inventors have discovered that the inclusion in a liquid detergent composition having the above-mentioned composition of anionic surfactants and polyethylene glycol (PEG) with a molecular weight of 4,000 to 6,000 Da in a concentration of 2 to 4 wt. % reduces the viscosity of the liquid detergent composition and at the same time flattens the viscosity curve in the temperature range of 10° C. to 40° C., and is also able to form a high amount of stable foam.

Thus the liquid detergent composition of the present invention employs a) an appropriate mixture of anionic surfactants such that the formulation possesses high foaming properties without compromising on cleaning benefits; and b) includes polymers such as PEG to keep the viscosity stable across a range of temperatures.

Since the amount of liquid detergent composition that is dispensed from a container is strongly dependent on the viscosity thereof, the liquid detergent of the present invention offers the advantage that within the temperature range of normal use, its flow characteristics are predictable. This is of particular relevance when the liquid detergent composition is applied in hand held devices that gradually release the detergent composition when the device is used to rub fabric during washing by hand. This kind of washing by hand is done at temperatures that can range from less than 10° C. to more than 40° C.

The liquid detergent composition of the present invention additionally offers the advantage that it produces a stable foamy lather. Especially when detergent compositions are applied to wash laundry by hand, the ability to form a strong lather is an important quality feature.

The invention further relates to a method of cleaning a textile, said method comprising contacting the textile with a liquid detergent or an aqueous dispersion of liquid detergent, wherein the liquid detergent is a liquid detergent composition according to the present invention.

In yet another aspect, the invention also relates to a kit for applying the liquid detergent composition disclosed herein onto fabric, the kit comprising a device for dispensing the liquid detergent and a liquid detergent composition, said device comprising: a compartment for holding a liquid detergent composition; a fluid dispensing system for dispensing the liquid detergent composition from the compartment through one or more dispensing openings via a valve system, said dispensing system comprising one or more activators extending outside of the device; wherein the one or more activators are operably connected to the valve system to open the valve system and to thereby enable release of the liquid detergent from the compartment through the one or more openings when pressure is exerted onto the one or more activators, and to close the valve system and thereby inhibit release of the liquid detergent composition through the one or more openings when no pressure is exerted onto the one or more activators.

DETAILED DESCRIPTION OF THE INVENTION

Accordingly, a first aspect of the invention relates to a high foaming liquid detergent composition comprising:

- 5 to 17.5 wt. % of one or more anionic surfactants selected from non-alkoxylated non-soap anionic surfactant and alkoxylated anionic surfactant in a weight ratio of 2:1 to 5:1, said non-alkoxylated non-soap anionic surfactant being selected from linear alkylbenzene sulphonate, alpha-olefin sulphonate, methyl ester sulphonate, primary alcohol sulphate and combinations thereof;
- 0 to 0.5 wt. % of one or more nonionic surfactants;
- 2 to 4 wt. % of polyethylene glycol having a molecular weight of 4,000 Da to 6,000 Da;
- at least 50 wt. % water;

wherein the liquid detergent composition has a viscosity at 25° C. and 20 $s^{-1}$ in the range of 5 to 100 mPa $s^{-1}$, wherein the liquid detergent composition has a pH of 7.0 to 7.5, wherein the liquid detergent composition forms a foam volume of at least 100 ml, and wherein the liquid laundry composition has stable viscosity between a temperature range of 10 and 40° C.

In context of the present invention, a viscosity-temperature sensitivity factor $K_\eta$ of less than 12.04 across a temperature range of 10 to 40° C. is desired. A $K_\eta$ of less than 12.04 indicates that the viscosity of the liquid detergent composition does not change much as a function of temperature. The viscosity-temperature sensitivity factor being calculated according to the following equation:

$$K_\eta=(\eta_{10})/\eta_{40};$$

wherein $\eta_T$ is the viscosity in cP at a shear rate of 20 $s^{-1}$ and a temperature T in ° C.

The term "alkoxylated anionic surfactant" as used herein refers to an anionic surfactant comprising one or more $C_{1-3}$ alkylene oxide residues.

The term "nonionic surfactant" as used herein refers to a surfactant that, unlike ionic surfactants, the hydrophilic 'head' does not contain a charged group.

The term "polyethylene glycol" as used herein refers to a polymer that is represented by the following formula: $H—(O—CH_2—CH_2)_n—OH$.

The viscosity of the liquid detergent composition at temperature T is determined by means of an AR1000 rheometer (TA Instruments) at 20 $s^{-1}$ shear rate, using a cone and plate (6 cm diameter; 1.59 degree cone truncation-54 microns).

All percentages mentioned herein are weight/weight percentages unless otherwise indicated.

The water content of the liquid detergent composition is preferably at least 35 wt %, more preferably at least 45 wt %, even more preferably 55 wt. %, more preferably at least 65 wt. %, and most preferably at least 70 wt. %.

The liquid detergent composition of the present invention preferably has a viscosity at 25° C. and 20 $s^{-1}$ in the range of 5 to 100 mPa s-1, 8 to 150 mPa s-1, more preferably in the range of 12 to 100 mPa s-1, even more preferably in the range of 15 to 80 mPa s-1.

As explained, the liquid detergent composition of the present invention offers the advantage that it exhibits a relatively flat viscosity curve in the temperature range of 10 to 40° C.

Most of liquid detergent compositions have high exponential decay function for viscosity with temperature. The present invention discloses liquid detergent compositions that have a low viscosity decay function across a range of temperatures. This is particularly advantageous for maintaining predictable flow characteristics of the composition across a range of temperatures at which the composition is typically used by a consumer for hand-wash application of the composition utilizing a hand-held dispensing device.

In a particularly preferred embodiment, the viscosity-temperature sensitivity factor $K_\eta$ of the liquid detergent composition is less than 3.5, preferably less than 3.0, more preferably less than 2.5, said viscosity-temperature sensitivity factor being calculated according to the following equation:

$$K_\eta=(\eta_{10})/\eta_{40}$$

wherein $\eta_T$ is the viscosity of the liquid detergent composition in cP, at a shear rate of 20 $s^{-1}$ and at a temperature T in ° C.

The liquid detergent composition of present invention preferably has a foam volume of at least 90 ml at 25° C., more preferably greater than 100 ml.

The liquid detergent composition preferably contains at least 0.6 wt. %, more preferably 0.8-5 wt. %, even more preferably 1.0-4 wt. % of polyethylene glycol having a molecular weight of 1,000 to 10,000 Da. More preferably, the composition contains at least 0.6 wt. %, more preferably at least 0.8-5 wt. %, even more preferably 1.0-4 wt. % of polyethylene glycol having a molecular weight of 1,200 to 6,000 Da. Most preferably, the composition comprises of at least 2 to 4% by weight of polyethylene glycol having a molecular weight of 4000 to 6000 Da.

In accordance with another preferred embodiment, the liquid detergent composition in a kit of the invention preferably contains at least 0.8 wt. %, more preferably 0.9-4 wt. % of alkoxylated polyethylene imine. The alkoxylated polyethylene imine employed in the liquid detergent composition preferably is an ethoxylated and/or propoxylated polyethylene imine. Most preferably, the alkoxylated polyethylene imine is ethoxylated polyethylene imine.

The alkoxylated polyethylene imine can be represented as PEI(X)YAO where X represents the molecular weight of the unmodified polyethylene imine (PEI) and Y represents the average moles of alkoxylation (AO) per nitrogen atom in the polyethylene imine backbone. The alkoxylation number Y may range from 7 to 40 alkoxy moieties per nitrogen atom, preferably it is in the range of 16 to 26, most preferably of 18 to 22. The molecular weight X preferably is in the range of 300 to 10,000 g/mol, most preferably 400-1,000 g/mo. A preferred EPEI is available under the tradename of Sokalan HP20 (ex. BASF).

According to a particularly preferred embodiment, the liquid detergent composition contains 0-5 wt. %, more preferably 0-3 wt. % and most preferably –2 wt. % of a polymeric thickener selected from carboxylated vinyl polymers, such as polyacrylic acids and sodium salts thereof;

alkoxylated cellulose; polyacrylamide; xanthan; sodium alginate; anionic acrylic copolymers (like acusol WR, acusol 801S, acusol 830, acrysol HASE and ASE, Novethix HASE etc.) and combinations thereof.

According to a particularly preferred embodiment, the liquid detergent composition contains alkoxylated anionic surfactant and non alkoxylated non soapanionic surfactant in a weight ratio that exceeds 2:1, more preferably in a weight ratio that exceed 4:1, most preferably in a weight ratio that exceed 9:1.

The alkoxylated anionic surfactant is preferably present in the liquid detergent composition in a concentration of at least 1 wt. %, more preferably of at least 2 wt. % and even more preferably of 3-10 wt. %.

The alkoxylated anionic surfactant employed in accordance with the present invention preferably is an alkoxylated anionic surfactant represented by the following formula:

$$CH_3(CH_2)_x(OCH_2CH_2)_yOSO_3^-M^+;$$

wherein:

x is an integer in the range of 8 to 18, preferably in the range of 12-14;

y is an integer in the range of 1 to 6, preferably of 1 to 3;

$M^+$ represents $Na^+$, $K^+$ or $NH_4^+$.

According to a particularly preferred embodiment, the alkoxylated anionic surfactant is lauryl ether sulphate.

The non-alkoxylated non-soap anionic surfactant is preferably present in the liquid detergent composition in a concentration of at least 1 wt. %, more preferably of at least 5 wt. %, even more preferably 8-25 wt. % and most preferably of 10-20 wt. %.

In a preferred embodiment, linear alkylbenzene sulphonate is present in the liquid detergent composition in a concentration of at least 1 wt. %, more preferably of at least 5 wt. %, even more preferably 8-25 wt. % and most preferably of 10-20 wt. %.

The linear alkylbenzene sulphonate employed in accordance with the present invention preferably has an alkyl chain length of 8 to 18, more preferably of 12 to 14.

In a preferred embodiment, the liquid detergent composition contains 0-2 wt. % of methyl ester sulphonate. More preferably, the liquid detergent composition contains 0.3-1.8 wt. %, even more preferably 0.5-1.5 wt. %, most preferably 0.7-1 wt. % of a methyl ester sulphonate.

The methyl ester sulphonate that may be employed in the liquid detergent composition is preferably represented by the following formula: $RCH(SO_3^-M^+)COOCH_3$, wherein R represents $C_{12-18}$ alkyl and $M^+$ represents $Na^+$ or $K^+$.

The alpha-olefin sulphonate that is optionally contained in the liquid detergent composition preferably is a $C_{12-18}$ alpha-olefin sulfonate. The sulfonate is preferably applied in the form of the sodium salt and/or potassium salt.

The primary alcohol sulphate that may be employed in the present liquid detergent composition preferably is represented by the following formula: $RSO_4^-M^+$, wherein R represents $C_{10-18}$ alkyl, preferably $C_{12-14}$ alkyl and wherein $M^+$ represent $Na^+$ or $K^+$.

The alkoxylated anionic surfactant and the non-alkoxylated non-soap anionic surfactant are preferably present in the liquid detergent composition in a weight ratio in the range of 10:90 to 80:20, more preferably of 15:85 to 50:50, most preferably in a weight ratio in the range of 20:80 to 40:60.

According to a particularly preferred embodiment, the liquid detergent composition of the present invention contains at least 10 wt. % linear alkylbenzene sulphonate, at least 3 wt. % lauryl ether sulphate, and the linear alkylbenzene sulphonate and the lauryl ether sulphate are present in a weight ratio of 2:1 to 5:1.

Nonionic surfactants and fatty acids have an adverse impact on the lather that is produced by the liquid detergent composition when it is applied in the manual washing of laundry. Consequently, the liquid detergent composition preferably contains no more than very limited quantities of these components.

The liquid detergent composition of the present invention preferably contains not more than 1.8 wt. %, more preferably not more than 1.5 wt. % and most preferably not more than 1.0 wt. % of nonionic surfactant, said percentages being calculated by weight of the liquid detergent composition.

Examples of nonionic surfactants that may be employed in the liquid detergent composition include primary and secondary alcohol ethoxylates, especially $C_8$-$C_{20}$ aliphatic alcohol alkoxylated with an average of from 1 to 20 moles of ethylene oxide per mole of alcohol, and more especially the $C_{10}$-$C_{16}$ primary and secondary aliphatic alcohols alkoxylated with an average of from 1 to 10 moles of ethylene oxide per mole of alcohol. Non-alkoxylated nonionic surfactants include alkyl polyglycosides, glycerol monoethers and polyhydroxy amides (glucamide).

In a preferred embodiment, the liquid detergent composition contains 0-2 wt. % of $C_{10}$-$C_{22}$ fatty acids. More preferably, the liquid detergent composition contains 0.3-1.8 wt. %, even more preferably 0.5-1.5 wt. %, most preferably 0.7-1 wt. % of $C_{10}$-$C_{22}$ fatty acids.

Preferably, the liquid detergent composition has a pH in the range of 6-11, more preferably in the range of 7-10, even more preferably in the range of 8-9.

In another preferred embodiment, the liquid detergent composition contains 0-10 wt. %, more preferably 0-5 wt. % of builder. Examples of builders that may be employed include phosphate salts as well as various organic and inorganic non-phosphorus builders.

Examples of non-phosphorus organic builders that may be used include the various alkali metal, ammonium and substituted ammonium polyacetates, carboxylates, polycarboxylates and polyhydroxy sulfonates. Examples of suitable non-phosphorus, inorganic builders include silicates, aluminosilicates, borates and carbonates.

Preferably, the composition contains less than 3 wt. %, more preferably less than 2 wt. %, even more preferably less than 1 wt. % of one or more water-soluble builder salts selected from orthophosphates, pyrophosphates, tripolyphosphates, silicates, borates, carbonates, sulphates, citrates, nitrilotriacetates and carboxymethyloxy succinates.

According to a particularly preferred embodiment, the liquid detergent composition contains 0-5 wt. %, more preferably 0-3 wt. % and most preferably 0-2 wt. % of a polymeric thickener selected from carboxylated vinyl polymers, such as polyacrylic acids and sodium salts thereof; alkoxylated cellulose; polyacrylamide; xanthan; sodium alginate; anionic acrylic copolymers (like acusol WR, acusol 801S, acusol 830, acrysol HASE and ASE, Novethix HASE etc.) and combinations thereof.

In yet another preferred embodiment, the liquid detergent composition contains 0-1 wt. %, more preferably 0.3-0.8 wt. %, even more preferably less than 0.5 wt. % of non-dissolved particulate material. Examples of ingredients that may be present in the liquid detergent composition as non-dissolved particulate material include enzyme preparations, coated bleaching agents and combinations thereof.

The liquid detergent composition preferably contains at least 0.5% hydrotrope, said hydrotrope preferably being selected from monopropyleneglycol, glycerol, sodium cumene sulfonate, sodium xylene sulfonate, potassium toluene sulfonate and combinations thereof.

In another preferred embodiment, the liquid detergent composition of the present invention comprises betaine. Preferably, liquid detergent composition contains betaine in a concentration of not more than 5% by weight and more preferably not more than 3% by weight, said percentages being calculated by weight of the one or more anionic surfactants. Suitable betaines include alkylamidopropylbetaines, wherein the alkyl residue comprises 8-18, preferably 12-14 carbon atoms. Preferred are lauramidopropyl betaine and cocamidopropyl betaine.

Other ingredients that may be present in the liquid detergent composition include: enzymes, fluorescer, bleach, antideposition aids, amine oxide surfactants and fragrances.

A second aspect of the invention relates to a method of cleaning a textile, the method comprising contacting the textile with a liquid detergent or an aqueous dispersion of liquid detergent, wherein the liquid detergent is a liquid detergent composition according to the present invention.

In a further preferred embodiment, the method comprises selectively applying the liquid detergent onto a soiled area of the textile.

Yet another aspect of the invention relates to a method of washing laundry comprising:

- providing a device for dispensing liquid detergent as defined herein, the compartment of said device being filled with the liquid detergent composition according to the present invention; and
- rubbing the dispensing device across a fabric to dispense the liquid detergent composition from the compartment of the device through the one or more dispensing openings onto the fabric.

A third aspect of the invention relates to a kit for applying the liquid detergent composition disclosed herein onto fabric, the kit comprising a device for dispensing the liquid detergent and a liquid detergent composition, said device comprising: a compartment for holding a liquid detergent composition; a fluid dispensing system for dispensing the liquid detergent composition from the compartment through one or more dispensing openings via a valve system, said dispensing system comprising one or more activators extending outside of the device; wherein the one or more activators are operably connected to the valve system to open the valve system and to thereby enable release of the liquid detergent from the compartment through the one or more openings when pressure is exerted onto the one or more activators, and to close the valve system and thereby inhibit release of the liquid detergent composition through the one or more openings when no pressure is exerted onto the one or more activators.

The term "valve system" as used herein refers to a regulation system which regulates the flow of the liquid detergent composition from the compartment through the one or more dispensing openings.

In one embodiment of the kit of the present invention, the liquid detergent composition is present in the compartment of the dispensing device.

In another embodiment, the kit comprises an empty dispensing device (i.e. a device whose compartment does not contain the liquid detergent composition) and a container that holds the liquid detergent composition. The latter container preferably have a volume in the range of 10 to 2,000 ml, more preferably a volume in the range of 50 to 500 ml.

The compartment of the dispensing device that is part of the present kit preferably has an internal volume in the range of 5 to 500 ml, more preferably in the range of 20 to 250 ml and more preferably of 50 to 150 ml.

The dispensing device in the present kit preferably is shaped as a cuboid, more preferably a rectangular cuboid.

The outside of the dispensing device is preferably made of non-flexible material. In other words, the outside of the dispensing device is preferably rigid.

The compartment of the dispensing device is preferably provided with a liquid inlet port in the wall to aid filling of the liquid detergent composition into the compartment. The inlet port is preferably provided with an air tight closure mechanism. This air tight closure mechanism should allow easy refilling of the compartment with the liquid detergent composition with minimum spoilage.

The fluid dispensing system is preferably housed in the compartment, more preferably the fluid dispensing system is extending between the top and bottom faces of the compartment. The one or more dispensing openings in the compartment are preferably located in the bottom face of the compartment.

The compartment preferably comprises an air chamber comprising an air vent for allowing air into the compartment when liquid detergent composition is being released. The air chamber is preferably located in the wall of the compartment and more preferably located in the top face of the compartment.

It is preferable that the fluid dispensing system extends between the bottom face of the compartment having the one or more dispensing openings and the air chamber located in the wall of the container. The valve system and the air chamber are preferably operably connected.

The one or more activators of the dispensing device are preferably actuated by application of a predetermined minimum pressure. This minimum pressure should be sufficiently high to prevent accidental opening of the valve system, e.g. during transport.

The invention is further illustrated by the following non-limiting examples.

EXAMPLES

Example 1

Liquid detergent formulations were prepared on the basis of the recipes shown in Table 1. The pH of formulations was 7.3.

TABLE 1

| | % by weight | | | | | | |
|---|---|---|---|---|---|---|---|
| Ingredients | 1 | 2 | 3 | 4 | 5 | 6 | 7 |
| Water | Balance (to 100) | | | | | | |
| Monopropylene glycol | 1.125 | 1.125 | 1.125 | 1.125 | 1.125 | 1.125 | 1.125 |
| Triethanol amine | 2.063 | 2.063 | 2.063 | 2.063 | 2.063 | 2.063 | 2.063 |
| Linear alkyl benzene sulphonate | 12.81 | 12.81 | 12.81 | 12.81 | 12.81 | 12.81 | 12.81 |
| Sodium lauryl ether sulphate | 4.5 | 4.5 | 4.5 | 4.5 | 4.5 | 4.5 | 4.5 |
| Preservative, perfume, coloring | 0.567 | 0.567 | 0.567 | 0.567 | 0.567 | 0.567 | 0.567 |
| Cocoamidopropyl betaine | 0.42 | 0.42 | 0.42 | 0.42 | 0.42 | 0.42 | 0.42 |
| Ethylene glycol | | 1 | | | | | |
| PEG-200 | | | 1 | | | | |
| PEG-1000 | | | | 1 | | | |
| PEG-6000 | | | | | 1 | | |
| PEG-17500 | | | | | | 1 | |
| PEG-100000 | | | | | | | 1 |

The viscosities of these liquid detergents as well as their capacity to produce high amounts of foam volume or lathering capacities were measured at 10° C., 25° C. and 40° C. The results are summarized in Table 2.

TABLE 2

| | 1 | 2 | 3 | 4 | 5 | 6 | 7 |
|---|---|---|---|---|---|---|---|
| 10° C. | 915 | 866 | 311 | 160 | 106 | 278 | 373 |
| 25° C. | 102 | 93 | 45 | 49 | 37 | 83 | 136 |
| 40° C. | 24 | 23 | 14 | 21 | 17 | 33 | 58 |
| $K_\eta$ | 38.12 | 37.65 | 22.21 | 7.62 | 6.24 | 8.42 | 6.43 |
| Lather Volume (ml) | 42 | NA | 43 | 100 | 115 | 52 | 56 |

Example 2

Liquid detergent formulations were prepared on the basis of the recipes shown in Table 3. The pH of formulations was 7.3.

TABLE 3

| | % by weight | | | | | | |
|---|---|---|---|---|---|---|---|
| Ingredients | 1 | 2 | 3 | 4 | 5 | 6 | 7 |
| Water | Balance (to 100) | | | | | | |
| Monopropylene glycol | 1.125 | 1.125 | 1.125 | 1.125 | 1.125 | 1.125 | 1.125 |
| Triethanol amine | 2.063 | 2.063 | 2.063 | 2.063 | 2.063 | 2.063 | 2.063 |
| Linear alkyl benzene sulphonate | 12.81 | 12.81 | 12.81 | 12.81 | 12.81 | 12.81 | 12.81 |
| Sodium lauryl ether sulphate | 4.5 | 4.5 | 4.5 | 4.5 | 4.5 | 4.5 | 4.5 |
| Preservative, perfume, coloring | 0.567 | 0.567 | 0.567 | 0.567 | 0.567 | 0.567 | 0.567 |
| Cocoamidopropyl betaine | 0.42 | 0.42 | 0.42 | 0.42 | 0.42 | 0.42 | 0.42 |
| PEG-2000 | 2 | | | | | | |
| PEG-3000 | | 2 | | | | | |
| PEG-4000 | | | 2 | | | | |
| PEG-6000 | | | | 2 | | | |
| PEG-8000 | | | | | 2 | | |
| PEG-10000 | | | | | | 2 | |
| PEG-12000 | | | | | | | 2 |

The viscosities of these liquid detergents were measured at 10° C., 25° C. and 40° C. The results are summarized in Table 4.

TABLE 4

| | 1 | 2 | 3 | 4 | 5 | 6 | 7 |
|---|---|---|---|---|---|---|---|
| 10° C. | 40 | 44 | 49 | 67 | 81 | 91 | 117 |
| 25° C. | 16 | 18 | 21 | 28 | 36 | 40 | 53 |
| 40° C. | 8 | 10 | 11 | 15 | 19 | 21 | 27 |
| $K_\eta$ | 5.0 | 4.4 | 4.45 | 4.47 | 4.26 | 4.33 | 4.33 |

Example 3

Liquid detergent formulations were prepared on the basis of the recipes shown in Table 5. The pH of formulations was 7.3.

TABLE 5

| | % by weight | | | | |
|---|---|---|---|---|---|
| Ingredients | 1 | 2 | 3 | 4 | 5 |
| Water | Balance (to 100) | | | | |
| Monopropylene glycol | 1.125 | 1.125 | 1.125 | 1.125 | 1.125 |
| Triethanol amine | 2.063 | 2.063 | 2.063 | 2.063 | 2.063 |
| Linear alkyl benzene sulphonate | 12.81 | 12.81 | 12.81 | 12.81 | 12.81 |

TABLE 5-continued

| | % by weight | | | | |
|---|---|---|---|---|---|
| Ingredients | 1 | 2 | 3 | 4 | 5 |
| Sodium lauryl ether sulphate | 4.5 | 4.5 | 4.5 | 4.5 | 4.5 |
| Preservative, perfume, coloring | 0.567 | 0.567 | 0.567 | 0.567 | 0.567 |
| Cocoamidopropyl betaine | 0.42 | 0.42 | 0.42 | 0.42 | 0.42 |
| PEG-6000 | 0 | 1 | 2 | 3 | 4 |

The viscosities of these liquid detergents were measured at 10° C., 25° C. and 40° C. The results are summarized in Table 6.

TABLE 6

| | 1 | 2 | 3 | 4 | 5 |
|---|---|---|---|---|---|
| 10° C. | 915 | 106 | 67 | 54 | 49 |
| 25° C. | 102 | 37 | 28 | 25 | 23.5 |
| 40° C. | 27 | 17 | 15 | 14.5 | 14 |
| $K_\eta$ | 33.89 | 6.24 | 4.47 | 3.72 | 3.5 |

Example 4

Liquid detergent formulations were prepared on the basis of the recipes shown in Table 7. The pH of formulations was 7.3.

TABLE 7

| Ingredients | 1 | 2 | 3 | 4 | 5 | 6 | 7 |
|---|---|---|---|---|---|---|---|
| Water | Balance (to 100) | | | | | | |
| Monopropylene glycol | 1.125 | 1.125 | 1.125 | 1.125 | 1.125 | 1.125 | 1.125 |
| Triethanol amine | 2.063 | 2.063 | 2.063 | 2.063 | 2.063 | 2.063 | 2.063 |
| LAS | 12.81 | 12.81 | 12.81 | 12.81 | 12.81 | 12.81 | 12.81 |
| SLES | 4.5 | 4.5 | 4.5 | 4.5 | 4.5 | 4.5 | 4.5 |
| Pres., perfume, coloring | 0.567 | 0.567 | 0.567 | 0.567 | 0.567 | 0.567 | 0.567 |

TABLE 7-continued

| Ingredients | 1 | 2 | 3 | 4 | 5 | 6 | 7 |
|---|---|---|---|---|---|---|---|
| Cocoamidopropyl betaine | 0.42 | 0.42 | 0.42 | 0.42 | 0.42 | 0.42 | 0.42 |
| PEG-2000 | 2 | | | | | | |
| PEG-3000 | | 2 | | | | | |
| PEG-4000 | | | 2 | | | | |
| PEG-6000 | | | | 2 | | | |
| PEG-8000 | | | | | 2 | | |
| PEG-10000 | | | | | | 2 | |
| PEG-12000 | | | | | | | 2 |

The lathering capacity of the liquid detergents was evaluated as follows:

A 12"×15" cotton fabric is put in a tray.

24 FH water is poured (Cloth: Liquor 1:3.5) over the fabric and is spread uniformly all over the fabric.

0.5 ml of liquid detergent is spread evenly on different areas of fabric.

With the help of graduated pipette, 0.5 ml of a soil emulsion is dropped evenly on different areas of fabric.

Rub the fabric 10 times by holding each corner one by one. Cloth is loosely bundled up, is kneaded three times on the board and is squeezed with both hands.

Fabric is opened and is placed lightly on the lather collected in the tray and is loosely bundled again. Kneading and squeezing process is repeated two more times.

The lather is transferred in 500 ml measuring cylinder which is filled with 50 ml 24 FH water.

Lather volume is measured by recording the top and bottom foam readings in measuring cylinder.

The results are summarised in Table 8.

TABLE 8

| | 1 | 2 | 3 | 4 | 5 | 6 | 7 |
|---|---|---|---|---|---|---|---|
| Lather Volume (ml) | 42 | 105 | 170 | 120 | 100 | 65 | 67 |

Example 5

Liquid detergent formulations were prepared on the basis of the recipes shown in Table 9. The pH of formulations was 7.3.

TABLE 9

| | % by weight | |
|---|---|---|
| Ingredients | 1 | 2 |
| Water | Balance (to 100) | |
| Monopropylene glycol | 1.125 | 1.125 |
| Triethanol amine | 2.063 | 2.063 |
| Linear alkyl benzene sulphonate | 12.81 | 12.81 |
| Sodium lauryl ether sulphate | 4.5 | 4.5 |
| Preservative, perfume, coloring | 0.567 | 0.567 |
| Cocoamidopropyl betaine | 0 | 0.57 |
| PEG-2000 | 2 | 2 |

The viscosities of these liquid detergents were measured at 10° C., 25° C. and 40° C. The results are summarized in Table 10.

TABLE 10

| | 1 | 2 |
|---|---|---|
| 10° C. | 247 | 380 |
| 25° C. | 80 | 116 |
| 40° C. | 35 | 47 |
| $K_\eta$ | 7.06 | 8.09 |

The lathering capacity of the liquid detergents was evaluated as is described in Example 4. The results are summarised in Table 11:

TABLE 11

| | 1 | 2 |
|---|---|---|
| Lather Volume (ml) | 180 | 190 |

Example 6

Liquid detergent formulations were prepared on the basis of the recipes shown in Table 12. The pH of formulations were 7.3.

TABLE 12

| | % by weight | | | | | |
|---|---|---|---|---|---|---|
| Ingredients | 1 | 2 | 3 | 4 | 5 | 6 |
| Water | Balance (to 100) | | | | | |
| Monoethanol amine | 1.56 | 1.56 | 1.56 | 1.56 | 1.56 | 1.56 |
| Triethanol amine | 2.75 | 2.75 | 2.75 | 2.75 | 2.75 | 2.75 |
| Linear alkyl benzene sulphonate | 11.64 | 11.64 | 11.64 | 11.64 | 11.64 | 11.64 |
| Sodium lauryl ether sulphate | 4.36 | 4.36 | 4.36 | 4.36 | 4.36 | 4.36 |
| Preservative, perfume, coloring | 0.54 | 0.54 | 0.54 | 0.54 | 0.54 | 0.54 |
| Ethoxylated polyethyleneimine [1] | 0 | 0.5 | 1 | 1.5 | 2 | 3 |

[1] Sokalan HP20

The viscosities of these liquid detergents were measured at 10, 25 and 40° C. The results are summarized in Table 13.

TABLE 13

| | 1 | 2 | 3 | 4 | 5 | 6 |
|---|---|---|---|---|---|---|
| 10° C. | 1372 | 306 | 170 | 133 | 105 | 69 |
| 25° C. | 179 | 74 | 52 | 45 | 40 | 29 |
| 40° C. | 38 | 26 | 22 | 20 | 20 | 16 |
| $K_\eta$ - value | 36.1 | 11.7 | 7.7 | 6.6 | 5.2 | 4.3 |

Example 7

Liquid detergent formulations were prepared on the basis of the recipes shown in Table 14. The pH of formulations was 7.3.

TABLE 14

| Ingredients | 1 | 2 | 3 | 4 | 5 | 6 | 7 |
|---|---|---|---|---|---|---|---|
| Water (balance to 100) | | | | | | | |
| Monopropylene glycol | 1.125 | 1.125 | 1.125 | 1.125 | 1.125 | 1.125 | 1.125 |
| Triethanol amine | 2.063 | 2.063 | 2.063 | 2.063 | 2.063 | 2.063 | 2.063 |
| LAS | 12.81 | 12.81 | 12.81 | 12.81 | 12.81 | 12.81 | 12.81 |
| SLES | 4.5 | 4.5 | 4.5 | 4.5 | 4.5 | 4.5 | 4.5 |
| Pres., perfume, coloring | 0.567 | 0.567 | 0.567 | 0.567 | 0.567 | 0.567 | 0.567 |
| Cocoamidopropyl betaine | 0.42 | 0.42 | 0.42 | 0.42 | 0.42 | 0.42 | 0.42 |
| PEG-2000 | 2 | | | | | | |
| PEG-3000 | | 2 | | | | | |
| PEG-4000 | | | 2 | | | | |
| PEG-6000 | | | | 2 | | | |
| PEG-10000 | | | | | 2 | | |
| PEG-12000 | | | | | | 2 | |
| EPEI [1] | | | | | | | 2 |

[1] Sokalan HP20

The lathering capacity of the liquid detergents was evaluated as follows:

A 12"×15" cotton fabric is put in a tray.

24 FH water is poured (Cloth:Liquor 1:3.5) over the fabric and is spread uniformly all over the fabric.

0.5 ml of liquid detergent is spread evenly on different areas of fabric.

With the help of graduated pipette, 0.5 ml of a soil emulsion is dropped evenly on different areas of fabric.

Rub the fabric 10 times by holding each corner one by one. Cloth is loosely bundled up, is kneaded three times on the board and is squeezed with both hands.

Fabric is opened and is placed lightly on the lather collected in the tray and is loosely bundled again. Kneading and squeezing process is repeated two more times.

The lather is transferred in 500 ml measuring cylinder which is filled with 50 ml 24 FH water.

Lather volume is measured by recording the top and bottom foam readings in measuring cylinder.

The results are summarised in Table 15.

TABLE 15

| | 1 | 2 | 3 | 4 | 5 | 6 | 7 |
|---|---|---|---|---|---|---|---|
| Lather Volume (ml) | 50 | 105 | 170 | 120 | 65 | 67 | 103 |

Example 8

The viscosity of the liquid detergent compositions with 23% by weight of surfactant with varying amounts of PEG 6000 was compared with that of a liquid detergent composition with 17% by weight of total surfactant. Viscosity at temperature T is determined by means of an AR1000 rheometer (TA Instruments) at 20 $s^{-1}$ shear rate, using a cone and plate (6 cm diameter; 1.59 degree cone truncation-54 microns).

TABLE 16

| Product | Viscosity, cp |
|---|---|
| 23% Surfactant | |
| 23AD | 1723 |
| 23AD + 0.5% PEG 6000 | 465 |
| 23AD + 1% PEG 6000 | 305 |
| 23AD + 2% PEG 6000 | 204 |
| 17.5% Surfactant | |
| 17.5AD | 147 |
| 17.5AD + 0.25% PEG 6000 | 89 |
| 17.5AD + 0.75% PEG 6000 | 41 |
| 17.5 AD + 2% PEG 6000 | 28 |

Example 9

The change in viscosity of the formulations of the present invention were compared to prior art formulation disclosed in D1, example 1.

TABLE 17

| Formulation | Viscosity@5° C., cp | Viscosity@25° C., cp | Viscosity@45° C., cp |
|---|---|---|---|
| Unilever-17.5% AD + 2% PEG 6000 | 90.1 | 26.7 | 11 |
| Prior art formulation | 1900 | 709 | 283 |

The invention claimed is:

1. A high foaming liquid detergent composition comprising:

(a) 5 to 17.5 wt. % of anionic surfactants selected from non-alkoxylated non-soap anionic surfactant and alkoxylated anionic surfactant in a weight ratio of 2:1 to 5:1, wherein the non-alkoxylated non-soap anionic surfactant comprises linear alkylbenzene sulphonate, and the alkoxylated anionic surfactant comprises sodium lauryl ether sulphate;

(b) 0 to 0.5 wt. % of one or more nonionic surfactants;

(c) 2 to 4 wt. % of polyethylene glycol having a molecular weight of 4,000 Da to 6,000 Da;

(d) at least 50 wt. % water;

wherein the liquid detergent composition has a pH of 7.0 to 7.5, viscosity at 25° C. and 20 $s^{-1}$ in the range of 5 to 100 cP, wherein the liquid detergent composition forms a foam volume of at least 120 ml, and wherein the liquid detergent composition has stable viscosity between a temperature range of 10° C. and 40° C.

2. The liquid detergent composition according to claim 1, wherein the composition contains less than 3 wt. % of one or more water-soluble builder salts selected from orthophosphates, pyrophosphates, tripolyphosphates, silicates, borates, carbonates, sulphates, citrates, nitrilotriacetates and carboxymethyloxy succinates.

3. The liquid detergent composition according to claim 1, wherein the liquid detergent composition contains 0-2 wt. % of $C_{10}$-$C_{22}$ fatty acids.

4. The liquid detergent composition according to claim 1, wherein the liquid detergent composition contains 0-2 wt. % of methyl ester sulphonate.

5. The liquid detergent composition according to claim 1, wherein the liquid detergent composition contains at least 1 wt. % of sodium lauryl ether sulphate.

6. The liquid detergent composition according to claim 1, wherein the composition contains at least 1 wt. % of linear alkylbenzene sulphonate.

7. The liquid detergent composition according to claim 6, wherein the linear alkylbenzene sulphonate has an alkyl chain length of 8 to 18.

8. The liquid detergent composition according to claim 1, wherein the composition contains 0-1 wt. % of non-dissolved particulate material.

9. A method of cleaning textile comprising:

contacting the textile with a liquid detergent or an aqueous dispersion of liquid detergent, wherein the liquid detergent is a liquid detergent composition according to claim 1.

10. The method according to claim 9, wherein the method comprises the steps of:

(a) combining 5 to 50 ml of the liquid detergent composition with water to form a wash liquor; and (b) washing the textile with the wash liquor.

11. The method according to claim 10, wherein the method comprises selectively applying the liquid detergent onto a soiled area of the textile.

* * * * *